US006706956B1

(12) United States Patent
Gotoh

(10) Patent No.: US 6,706,956 B1
(45) Date of Patent: Mar. 16, 2004

(54) PEG MECHANISM AND PEG FOR STRINGED INSTRUMENTS

(75) Inventor: Masaki Gotoh, Isezaki (JP)

(73) Assignee: Gotoh Gut Co., LTD (JP)

( * ) Notice: Subject to any disclaimer, the term of this patent is extended or adjusted under 35 U.S.C. 154(b) by 0 days.

(21) Appl. No.: 09/936,667

(22) PCT Filed: Jul. 27, 2000

(86) PCT No.: PCT/JP00/05024

§ 371 (c)(1),
(2), (4) Date: Sep. 13, 2001

(87) PCT Pub. No.: WO01/52233

PCT Pub. Date: Jul. 19, 2001

(30) Foreign Application Priority Data

Jan. 13, 2000 (JP) ..... 2000-004432

(51) Int. Cl.[7] ..... G10D 3/14
(52) U.S. Cl. ..... 84/304; 84/305; 84/306
(58) Field of Search ..... 84/304, 305, 306

(56) References Cited

U.S. PATENT DOCUMENTS 5,998,713 A * 12/1999 Herin ..... 84/305

FOREIGN PATENT DOCUMENTS

| | | |
|---|---|---|
| JP | 5148030 | 10/1949 |
| JP | 5838193 | 9/1956 |
| JP | 3728652 | 10/1962 |
| JP | 429904 | 5/1967 |
| JP | 5877395 | 5/1983 |
| JP | 6030491 | 3/1985 |
| JP | 6049596 | 4/1985 |
| JP | 2802742 | 7/1998 |
| JP | 2819404 | 8/1998 |
| WO | WO8500916 | 2/1985 |

* cited by examiner

*Primary Examiner*—Kimberly Lockett
(74) *Attorney, Agent, or Firm*—Trexler, Bushnell, Giangiorgi, Blackstone & Marr, Ltd.

(57) ABSTRACT

A peg mechanism and peg for stringed instruments is provided. It requires no skilled techniques and dedicated tools for manufacturing and maintaining instruments easily. It is applicable to the existing instruments, easy to perform tuning and fine-tuning, and usable for a long time period in stable A certain number of cylindrical throughholes, each having an inner surface with an axially uniform diameter, are provided along the extending direction of strings and sequentially on a support wall formed in a head stock of a stringed instrument. A bushing composed of a abrasion quality material is sandwiched between a string post for winding a string and a knob for rotating the string post, and secured in the throughhole. An adjusting means is provided between the string post and the knob for relatively displacing the string post close to and apart from the knob by external operations.

16 Claims, 8 Drawing Sheets

PEG MECHANISM AND PEG FOR STRINGED INSTRUMENTS

FIELD OF THE INVENTION

The present invention relates to a peg mechanism and peg for stringed instruments mainly including violins, cellos, violas, samisens and folk instruments.

BACKGROUND OF THE INVENTION

A conventional peg mechanism for use in stringed instruments such as violins, cellos, violas and samisens comprises a pair of support walls 52A, 52B and string posts 54, for example, as shown in FIG. 7. The support walls 52A, 52B have a certain number of pairs of peg insertion holes 51, 51 in communication with each other, provided through a space 53 for winding strings formed in a head stock A of a stringed instrument, along the extending direction of strings. The string post 54 is inserted into the pair of throughholes 51, 51 and is rotated in the space 53 to wind a string. The throughhole 51 has an inner circumferential surface that is tapered along the insertion direction of the string post 54. The string post 54 has an outer circumferential surface that is tapered so as to contact tightly with the inner circumferential surface of the throughhole 51.

Such the peg mechanism for stringed instruments is configured to drive the string post 54 along the insertion direction and press the outer circumferential surface of the string post 54 to the tapered surface in the throughhole 51 to halt the rotation of the string post 54. It is further configured to press the string post 54 into the throughhole 51 to secure the string post 54 onto the support wall to some extent so as not to cause reverse rotations, of the string post in a tuned state, due to tension of the string. In case of a tuning operation for such the stringed instrument, the tuned state of the string post 54 that is pressed into the throughhole 51 is maintained. On the other hand, the string post 54 is pulled in the direction opposite to the insertion direction to release the string post 54 that is pressed into the tapered surface of the throughhole 51. In this stale, the string post 54 can be rotated to wind or unwind the string.

The peg mechanism that secures the string post onto the support wall using such the tapered surfaces, however, can not achieve a sufficient frictional resistance when the tight contact between the tapered surfaces is incomplete. In this case, the string post slips due to the tension of the string and varies the tuned condition of the string. Therefore, it is required to manufacture the tapered surface of the throughhole so that it can lightly contact with the tapered surface of the string post. In addition, skilled techniques and dedicated tools are required at the times of their manufacture and maintenance.

The string post is rotated and halted in the throughhole using the tapered surfaces. Thus, the string post rotates heavily when it is strongly inserted into the throughhole, and rotates lightly when it is weakly inserted into the throughhole. The degree of the insertion of the string post into the throughhole depends on the feeling of a player who employs the stringed instrument. Therefore, when the string post is inserted too strong, rotations of the string post may be inhibited. When the string post is inserted too weak, the string post may rotate inversely due to tension of the string and cause critical troubles such a s a state of out of tune in playing. Therefore, players are required to be skilled in tuning. In addition, the mechanism that employs the tapered surfaces can not avoid abrasions to occur on both tapered portions. In the above mechanism, a string is held with a contact pressure between wooden parts of the string post and the throughhole. Therefore, it is difficult to rotate the string post smoothly and, at the time of tuning, perform a fine-tuning to secure the string post at a desired location in the throughhole.

The string post is usually composed of wood or synthetic resin and is therefore abraded after a long time use. As a result, the tight contact with the throughhole varies and a normal tuning can not be performed. In this case, it is required to buy a new string post and readjust its tapered surface so as to meet with the tapered surface in the throughhole in the instrument. In addition, an operation is required to bore a new throughhole after filling the current throughhole in the instrument that is enlarged by abrasion. If the tapered surface of the string post meets with the taper of the throughhole, frequent tunings cause engagement of the string into the string post and wear the string post at a portion of winding the string, which will not be usable any more in short time. In these cases, in order to request an expert to repair the string post, the player must burden a routine maintenance cost and time.

To the contrary, FIG. 8 shows another conventional peg mechanism that utilizes tapered surfaces of a string post 54 and a throughhole 51. An engagement member 55 is provided at the tip end of the string post 54. The engagement member 55 is engaged in a tip end throughhole 51A and rotatably supports the string post 54. A fastener ring 56 is attached to the tapered surface of a base end throughhole 51B. The fastener ring 56 has a tapered diameter that decreases as the diameter of the base end throughhole 51B decreases. An adjusting means operative from external may be provided at the tip end of the string post 54 to slide the string post 54 axially about the engagement member 55 (See Japanese patent No. 2,802,742).

According to this peg mechanism, it is not required to make the tapered surface of the string post 54 precisely tight contact with that of the base end throughhole 51B. The need for providing tapered members such as the engagement member 55 and the fastener ring 56, however, complicates the structure. In addition, as it is required to taper the outer circumferential surface of the string post 54 and the inner circumferential surfaces of the tip end throughhole 51A and base end throughhole 51B, most of the above subjects to be solved in the prior art remain unsolved.

SUMMARY OF THE INVENTION

The present invention has an object to provide a peg mechanism and peg for stringed instruments, which are required to no skilled techniques and dedicated tools, and manufactured and maintained. It is applicable to the existing instruments, easy to perform tuning and fine-tuning, and usable for a long time period instable.

The present invention has been made to achieve the above object. A first aspect of the present invention provides a peg mechanism for stringed instruments, which comprises a certain number of cylindrical throughholes, each having an inner surface with an axially uniform diameter, provided along the extending direction of a string and sequentially on a support wall formed in a head stock of a stringed instrument; a bushing composed of a abrasion quality material sandwiched between a string post for winding a string and a knob for rotating the string post, and secured in the throughhole; and an adjusting means provided between the string post and the knob for relatively moving the string post close to and apart from the knob by external operations.

The bushing may be secured in the throughhole by a securing means which has anti-rotation pieces consisting of engaging projections such as knurls and protrusions formed on a circumferential surface of a portion adjacent to the inside of the throughhole. In this case, the bushing can be secured when it is simply driven into the throughhole. This is preferable to simplify the process steps.

A second aspect of the present invention provides a peg mechanism for stringed instruments, which comprises throughholes provided on a support wall formed in a head stock of a stringed instrument, the throughholes provided sequentially along the extending direction of a string; a string post, pivotally inserted in each of the throughholes, for winding a string, wherein the throughholes are each bored cylindrically to have an inner surface with an axially uniform diameter, the support wall at the throughhole part is sandwiched between the string post and a knob for rotating the string post, an adjusting means is provided in the string post and the knob for relatively moving the string post close to and apart from the knob by external operations, and planar members composed of a abrasion quality material such as a washer and a bushing are interposed between a string winder of the string post and the support wall and between the knob and the support wall, the planar members each having three or more projections contacting the support wall, formed at an appropriate interval.

The string post may be coupled to the knob for rotating the string post by an anti-rotation means which is movable axially but inhibited to rotate. For example, fit members for fitting one of the string post and the knob with the other and engaging with each other during rotations are preferable to simplify the configuration and insure the operation. In addition, at least one of the planar members may comprise a bushing secured in the throughhole, the bushing having engaging projections such as knurls and protrusions formed on a circumferential surface of a portion adjacent to the inside of the throughhole. In this case, the bushing can be secured when it is simply driven into the throughhole. This is preferable to simplify the process steps.

Further, the adjusting means may include a female threaded portion provided on the tip of one of the string post and the knob, the string post and the knob arranged on the same center line; and a male screw provided on the other of the string post and the knob, operative from external or engaging in and from the female threaded portion to relatively move the string post close to and apart from the knob. In this case, only with the rotation of the male screw, the sandwiching pressure given to the bushing or support wall from the string post and the knob can be adjusted. Thus, tuning of the string can be performed easily and firmly. In addition, any of the string post, the knob and the planar members can be replaced without special tools and techniques al the user side. This can preferably extend a maintenance period and reduce an expense.

A third aspect of the present invention provides a peg for stringed instruments, which comprises a string post consisting of a string winder and a shaft driver provided adjacent to the string winder; a knob coupled to the string post for rotating the string post; and a bushing composed of a abrasion quality material, sandwiched between the string post and the knob, and secured in a throughhole bored in a support wall of a head stock, wherein an anti-rotation means axially movable but inhibited to rotate, and an adjusting means provided between the string post and the knob for relatively moving the string post close to and apart from the knob by external operations are provided in the string post and the knob.

The bushing may be secured in the throughhole by a securing means which has anti-rotation pieces consisting of engaging projections such as knurls and protrusions formed on a circumferential surface of a portion adjacent to the inside of the throughhole. In this case, the bushing can be secured when it is simply driven into the throughhole. This is preferable to simplify the process steps.

A fourth aspect of the present invention provides a peg for stringed instruments, which comprises a string post consisting of a string winder and a shaft driver provided adjacent to the string winder, the shaft driver inserted into a throughhole bored in a support wall of a head stock in a stringed instrument; a knob coupled to the string post and having an anti-rotation means movable along the axis of the string winder of the string post but inhibited to rotate; and planar members secured in the throughholes, at a portion between the knob and the support wall, and at a portion between a string winder of the string post and the support wall, the planar members each having anti-rotation pieces into which the shaft driver is inserted, wherein an adjusting means is provided between the string post and the knob for relatively moving the string post close to and apart from the knob by external operations, the planar members comprise planar members such as a washer and a bushing composed of a abrasion quality material and having three or more projections contacting the support wall formed at an appropriate interval.

In these pegs according to the third and fourth aspects of the present invention, the anti-rotation means for the string post and the knob may comprise fit members for fitting one with the other and engaging with each other during rotations. For example, polygonal ones in section can simplify the configuration of the anti-rotation means and both can be produced easily. Further, the string post and the knob can be preferably inhibited to rotate firmly. The adjusting means may include a female threaded portion provided on the tip of on e of the string post and the knob, the string post and the knob arranged on the same center line; and a male screw provided on the other of the string post and the knob, operative from external for engaging in and from the female threaded portion to relatively displace the string post close to and apart from the knob. In this case, only with the rotation of the male screw, the sandwiching pressure given to the bushing or support wall from the string post and the knob can be adjusted. Thus, tuning of the string can be performed easily and firmly. In addition, any of the string post, the knob and the planar members can be replaced without special tools and techniques at the user side. This can preferably extend a maintenance period and reduce an expense.

Further, at least one of the planar members may comprise a bushing secured in the throughhole, the bushing having engaging projections such as knurls and protrusions formed on a circumferential surface of a portion adjacent to the inside of the throughhole. In this case, the bushing can be secured when it is simply driven into the throughhole. This is preferable to simplify the process steps.

BRIEF DESCRIPTION OF THE DRAWINGS

FIG. 3A is a plan view of a washer before formation of the protrusions, FIG. 3B is a plan view of a washer after formation of the protrusions. FIG. 3C is a central cross-sectional view of FIG. 3B, and FIG. 3D is a plan view of a washer according to another embodiment;

FIG. 6A is a perspective view of a bushing with protrusions formed on its flange, FIG. 6B is a perspective view of a bushing with protrusions formed on its outer circumferential surface, and FIG. 6C is a perspective view of a bushing with splines formed on its outer circumferential surface;

DETAILED DESCRIPTION OF THE PREFERRED EMBODIMENTS

Embodiment 1

Figure 1:
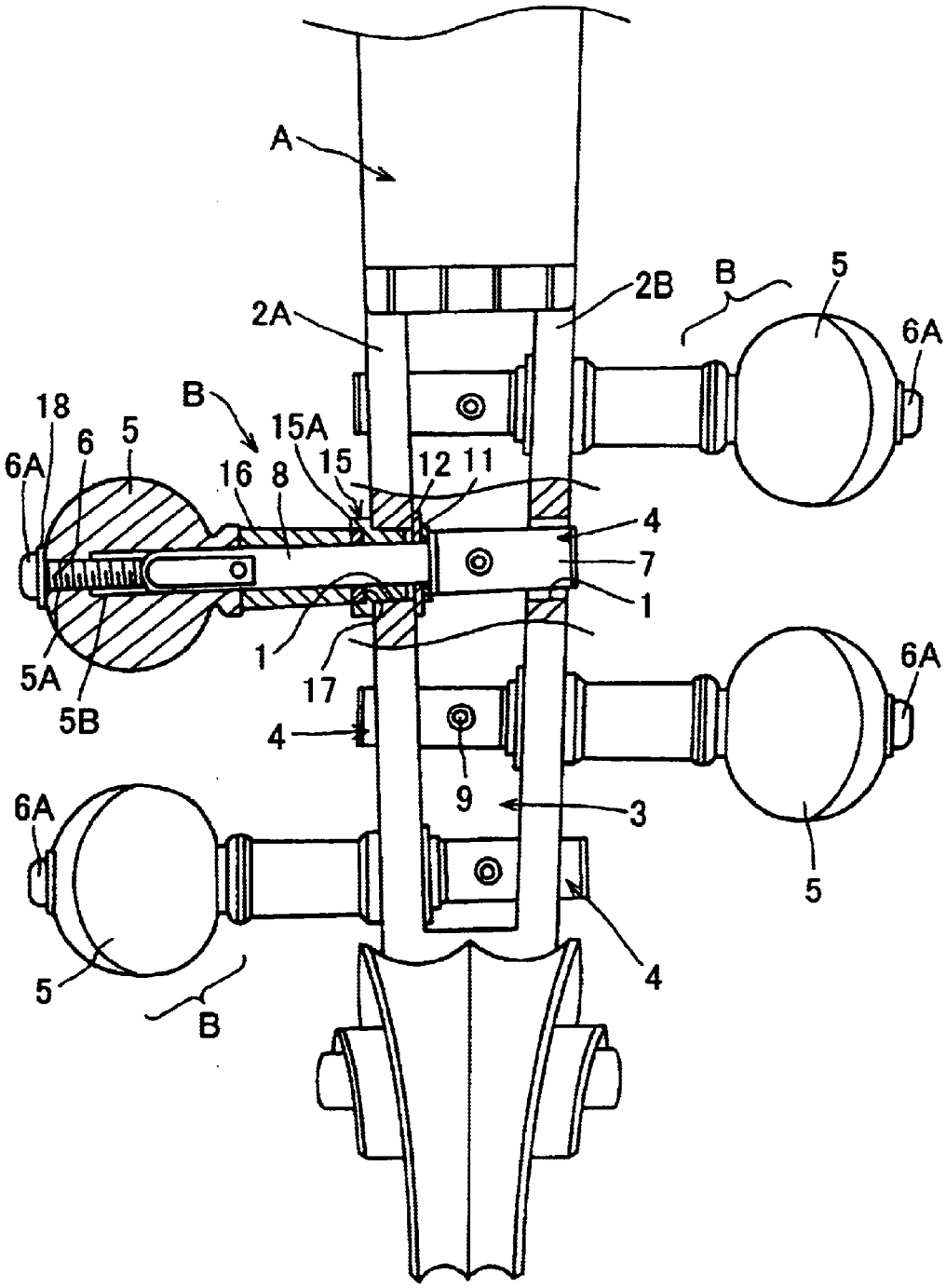
FIG. 1 is a partly sectioned plan view showing an embodiment of a peg mechanism for stringed instruments according to the present invention.

A first embodiment of a peg mechanism and peg for stringed instruments according to the first and third aspects of the present invention will be described on the basis of FIGS. 1–3. In a head stock A of a stringed instrument, a pair of support walls 2A, 2B are formed through a winding space 3. A certain number of pairs (4 pairs in this embodiment) of peg insertion holes 1, 1 are bored through the support walls 2A, 2B along the extending direction of strings. A peg B is inserted into each pair of the throughholes 1, 1, which are in communication with each other. The peg B comprises a string post 4, a knob 5 and a male screw 6. The string post 4 can be rotated in the space 3 to wind a string. The knob 5 is located outside the pair of support walls 2A. 2B and connected to the string post 4 so as to sandwich either the support wall 2A or the support wall 2B together with the string post 4. The male screw 6 is operable from external to axially slide the string post 4 relative to the knob 5. The pair of support walls 2A, 2B are provided approximately V-shaped, as shown in FIG. 1, slightly tapered toward the upper portion of the stringed instrument. The pair of throughholes 1, 1 formed through the support walls 2A, 2B are each bored straight to make an inner surface with an axially uniform diameter.

Figure 2:
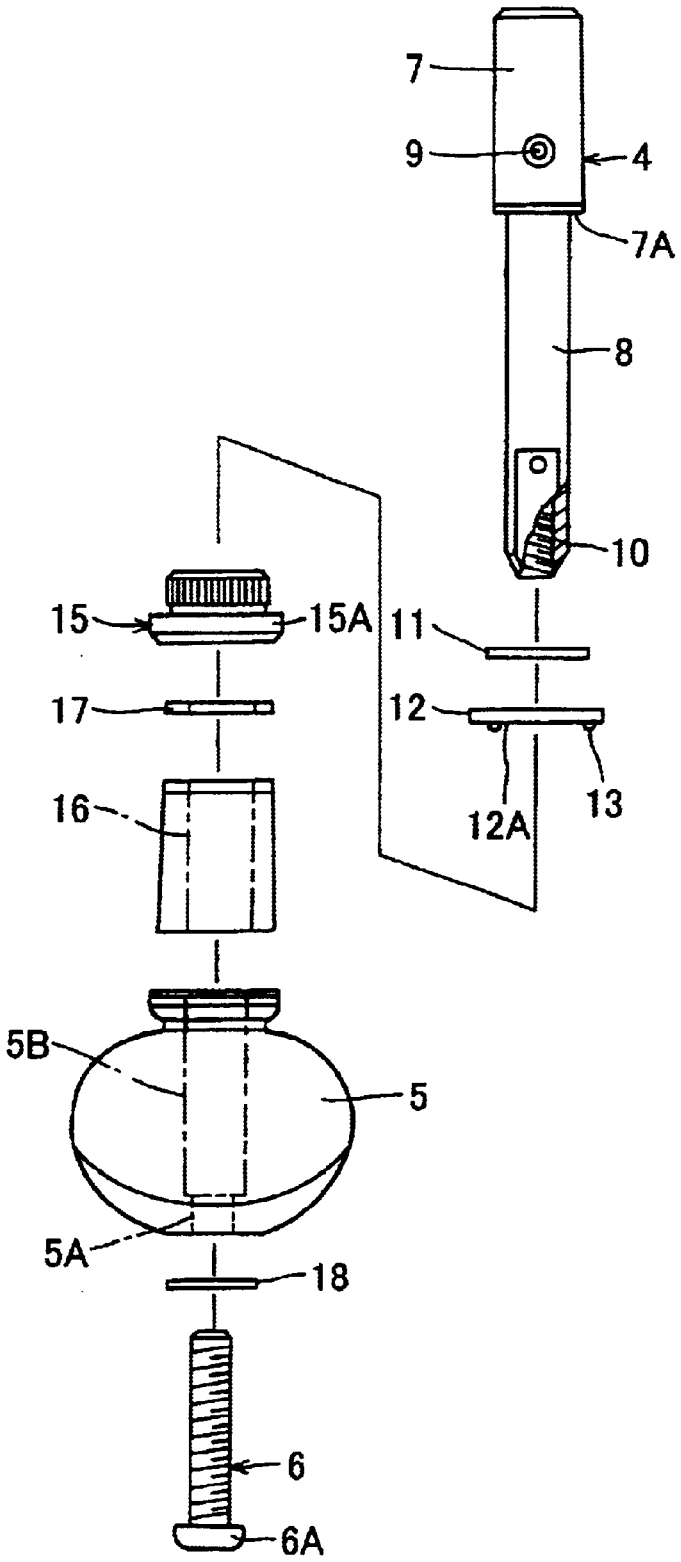
FIG. 2 is a partly sectioned exploded view showing an embodiment of a peg for stringed instruments according to the present invention.
Figure 3:
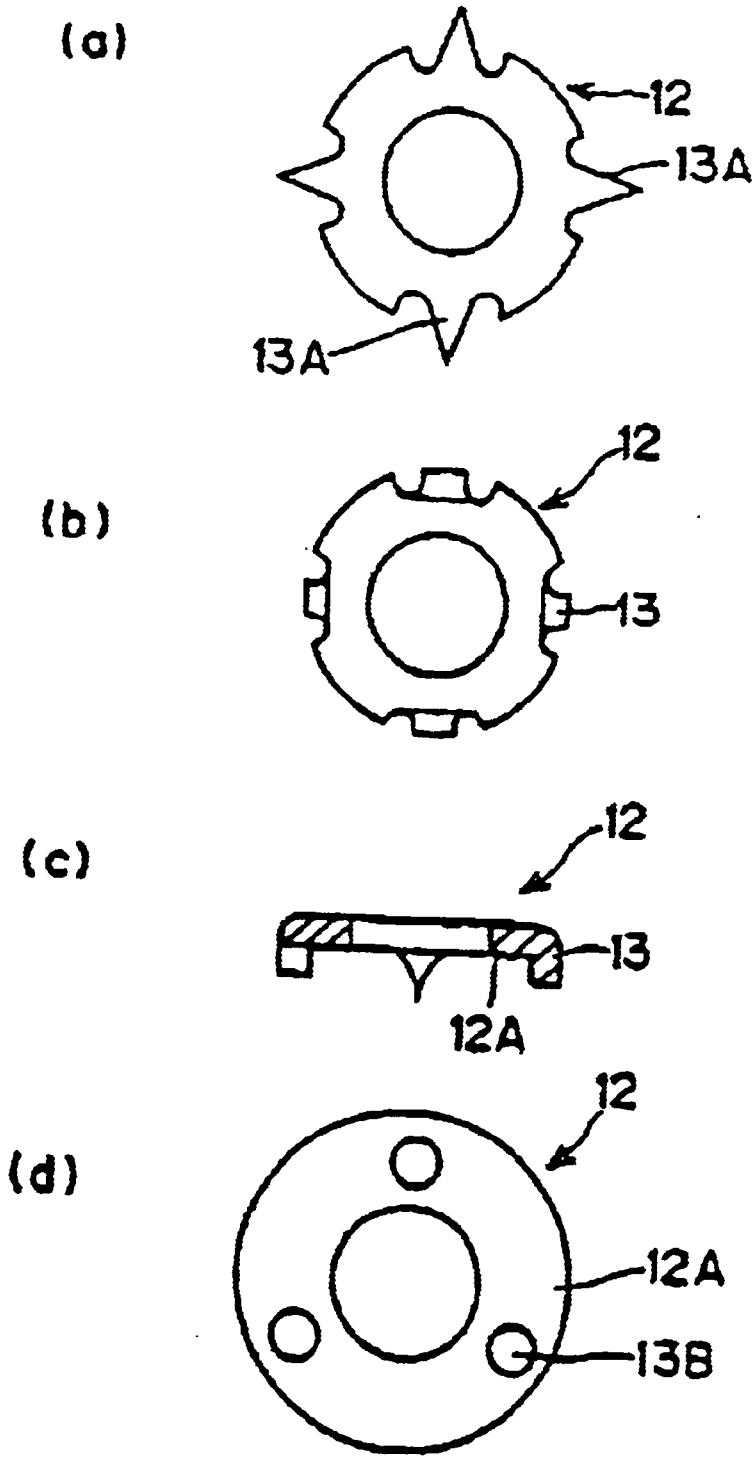
FIG. 3 exemplifies washers with protrusions for use in the peg according to the present invention.

The string post 4 comprises a string winder 7 and a shaft driver 8 as shown in FIGS. 1 and 2. The string winder 7 is formed cylindrical with an axially uniform diameter. It is inserted into the pair of throughholes 1, 1 in the support walls 2A. 2B. The shaft driver 8 supports the string winder 7 and is inserted into one of the pair of throughholes 1. 1 in the support walls 2A, 2B. A bore 9 is formed through the outer circumference of the string winder 7 slightly close from the center to the base end along the length of the string winder 7. The bore 9 is employed to attach a string. The shaft driver 8 has the base end (the right side in FIG. 2), which is coupled to the string winder 7, shaped columnar, and the tip end (the left side in FIG. 2), of which outer surface is shaped polygonal in section. The shaft driver 8 shaped polygonal has a threaded hole 10 formed in the tip along the axis to engage with the male screw 6 that is inserted from the top of the knob 5.

When the string post 4 is inserted into the throughholes 1, 1 in the support walls 2A, 2B, two washers 11, 12 are sandwiched between the base end 7A of the string winder 7 and an inner surface of the support wall 2A or 2B. The washer 12 adjacent to the support wall 2A or 2B has a surface 12A in contact with the support wall 2A or 2B. The contact surface 12A has four sharp-pointed projections 13A formed at an equal interval on parts of the periphery at the time of formation of the washer 12, as shown in FIGS. 3A–C, which are then bent to form protrusions 13 as anti-rotation pieces. These protrusions 13 may also be hemispherical protrusions 13B, as shown in FIG. 3D, pressed from the top surface to the back surface at the time of formation of the washer 12. Both of the protrusions 13, 13B may have arbitrary shapes and preferably they are each provided with three or more.

The knob 5 is shaped in the form of an approximate disk. The top of the knob 5 has a threaded bore 5A formed in the axial direction to insert the male screw 6 therein. The base end of the knob 5 has a polygonal fit bore SB for tightly contacting with the polygonal tip of the shaft driver 8 of the string post 4. Accordingly, when the polygonal portion of the shaft driver 8 is inserted into the fit bore 5B of the knob 5, the male screw 6 can be inserted through the tip of the knob 5 to engage with the threaded bore 10 of the shaft driver 8.

The knobs 5 are provided from the outside of the support wall 2A or 2B onto the string posts 4 alternately at left and right sides, as shown in FIG. 1, in the extending direction of strings. A bushing 15 is attached in each throughhole 1 in the support wall 2A or 2B, to which the knob 5 is attached from external. The bushing 15 has such a size that can receive the shaft driver 8 of the string post 4 therein. The bushing 15 has a n outer circumferential surface with splines formed thereon, as shown in FIG. 2, which effect like the protrusions 13 on the washer 12. The outer circumferential surface has such an outer diameter that the bushing 15 can be inhibited to rotate once it is secured in the throughhole 1 bored in the support wall 2A or 2B. The bushing 1S has a flange 15A at the base end, which has a diameter larger than that of the throughhole 1. The knob 5 can be attached to the support wall 2A or 2B through a color 16, a washer 17 and the bushing 15. The knob 5 may be molded integrally with the color 16. The male screw 6 can be inserted through the top of the knob 5 as described above. A washer 18 is sandwiched between the knob 5 and the head 6A of the male screw 6.

Operations of the peg mechanism and peg for stringed instruments according to this embodiment will be described next.

First, the string post 4 and the knob 5 sandwich the support wall 2A or 2B to secure them onto the support wall 2A or 2B at such the extent that t he string post 4 can not rotate due to tension of a string. In this case, when the male screw 6 is rotated in the normal direction to the knob 5, it moves forward relative to the shaft driver 8 of the string post 4. The tip of the shaft driver 8 of the string post 4 is configured polygonal. The polygonal tip of the shaft driver 8 is inserted into the fit bore 5B of the knob 5, which is configured axially movable but inhibited to rotate relative to tip of the shaft driver 8. Therefore, the knob 5 and the shaft driver 8 can not rotate relative to each other and the shaft driver 8 can be inserted into the fit bore 5B of the knob 5. Along with the insertion of the shaft driver 8, the string winder 7 also moves toward the knob 5 to sandwich the support wall 2A or 2B between the string post 4 and the knob 5. The sting post 4 and the knob 5 are secured to the support wall 2A or 2B at such the extent that the string post 4 can not rotate due to tension of a string by adjusting the rotational force of the male screw 6.

In the present embodiment, the string post 4 and the knob 5 are configured to sandwich either the support wall 2A or 2B. This sandwiching force can be adjusted when the string post 4 is relatively moved toward the knob 5 by the male screw 6. Accordingly, the string post 4 can be secured by the user at such the extent that it can not rotate due to tension of a string. During the tuning operation for strings, when the sandwiching force by the string post 4 and the knob 5 given to the support wall 2A or 2B decreases, the normal rotation of the male screw 6 can increase the sandwiching force to promote the tuning operation.

As the washer 12 with a plurality of protrusions 13 is interposed between the string winder 7 and the support wall 2A or 2B, a surface of the support wall 2A or 2B opposing to the string winder 7 may be uneven. In this case, when the protrusions 13 are pressed into the support wall 2A or 2B to integrate the washer 12 with the support wall 2A or 2B, the washer 12 can be maintained substantially in parallel with the bushing 15. Thus, the string winder 7 contacts in plane with the support wall 2A or 2B to unify a frictional resistance caused between the string winder 7 and the support wall 2A or 2B As a result, the string post 4 can pivot smoothly to promote a fine-tuning of the string.

Although described in the present embodiment is the stringed instrument that includes a pair of support walls in the head stock the invention is not limited to this example. Rather it is obvious that the invention is applicable to a stringed instrument that includes a single support wall in a head stock. In addition, it can be appreciated that as the planer members only a pair of washers with protrusions, a pair of simple bushings, or an appropriate combination of them can be employed.

Embodiment 2

A second embodiment of a peg mechanism and peg for stringed instruments according to the second and fourth aspects of the present invention will be described on the basis of FIGS. 4–6. The first embodiment is directed to the peg mechanism and peg for stringed instruments, which is basically characterized in that the string post 4 and the knob 5 are employed to sandwich the support wall 2A or 2B formed in the head stock through the throughhole 1 and that the thread 6 is employed to move the string post 4 close to and apart from the knob 5. To the contrary, the second embodiment is basically characterized in that a string post 4 and a knob are employed to sandwich a bushing secured in a throughhole 1 bored in a support wall 2A or 2B and that a thread 6 is employed to move the string post 4 close to and apart from the knob. Therefore, the same effective structures of the head stock and support walls of the stringed instrument, and of the throughholes, as those in the first embodiment may be employed similarly. Accordingly, different parts from the first embodiment and their associated mechanisms and peg will be mainly described herein. The same reference numerals as those in the first embodiment are employed to refer to the same parts with the same effects.

A peg C comprises a string post 4, a knob 21 and a male screw 6. The string post 4 can be rotated in a winding space 3 in a head stock A to wind a string. The knob 21 is located outside a pair of support walls 2A, 2B and connected to the string post 4 so as to sandwich a bushing 20 secured in the throughhole 1 in either the support wall 2A or 2B together with the string post 4. The male screw 6 is operable from external to slide the string post 4 relative to the knob 5.

Between the base end 7A of a string winder 7 and the bushing 20 in the string post 4, a space adjustment bushing 22 is sandwiched for adjusting a length of the string post 4 along the axis in accordance with a thickness of the support wall 2A or 2B. This adjustment is required when the string post 4 is inserted into the throughholes 1, 1 of the support walls 2A, 2B.

The knob 21 is shaped in the form of an approximate disk. The top of knob 21 has a threaded bore 5A formed in the axial direction to insert the male screw 6 therein. The base end of the knob 21 has a polygonal fit bore 5B for tightly contacting with the polygonal tip of the shaft driver 8 of the string post 4. Accordingly, when the polygonal portion of the shaft driver 8 is inserted into the fit bore 5B of the knob 21, the male screw 6 can be inserted through the tip of the knob 21 to engage with the threaded bore 10 of the shaft driver 8.

Figure 4:
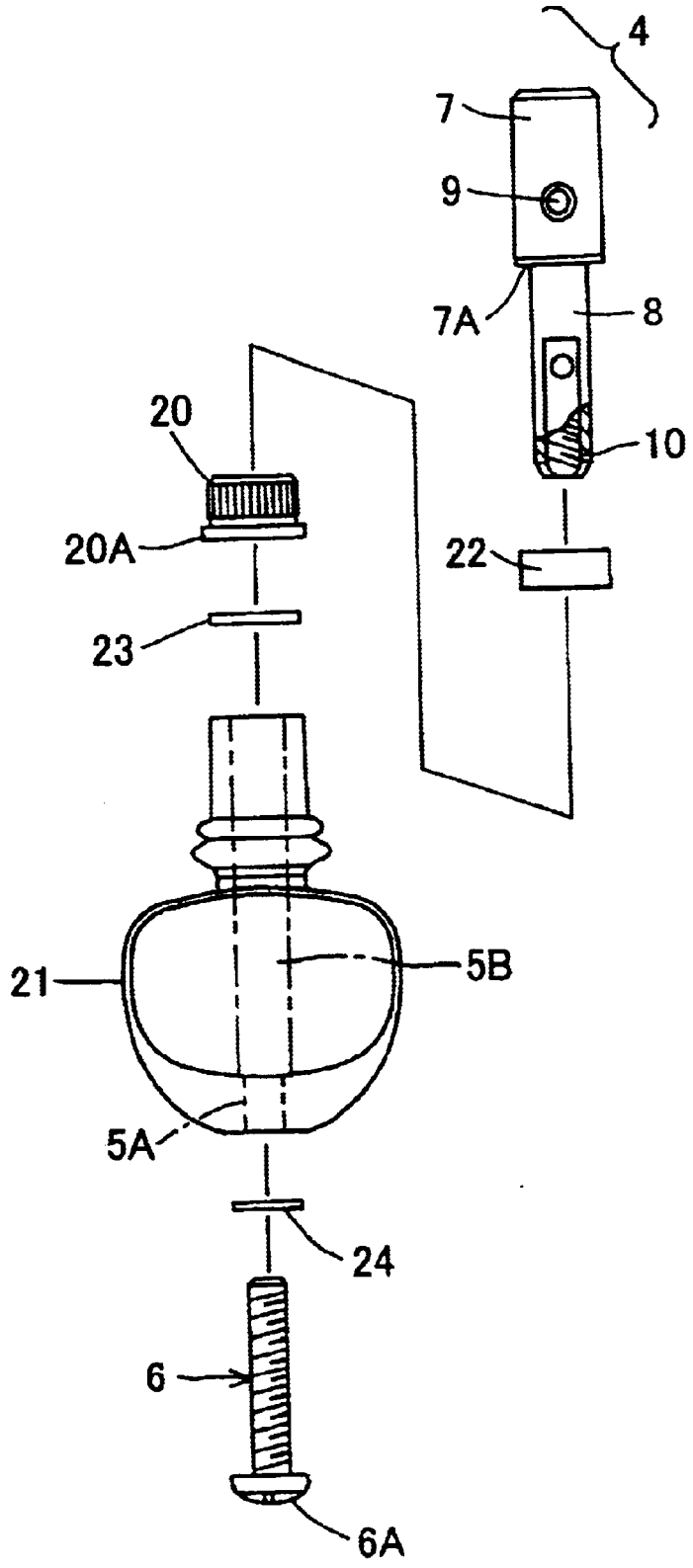
FIG. 4 is a partly sectioned plan view showing another embodiment of a peg mechanism for stringed instruments according to the present invention.
Figure 5:
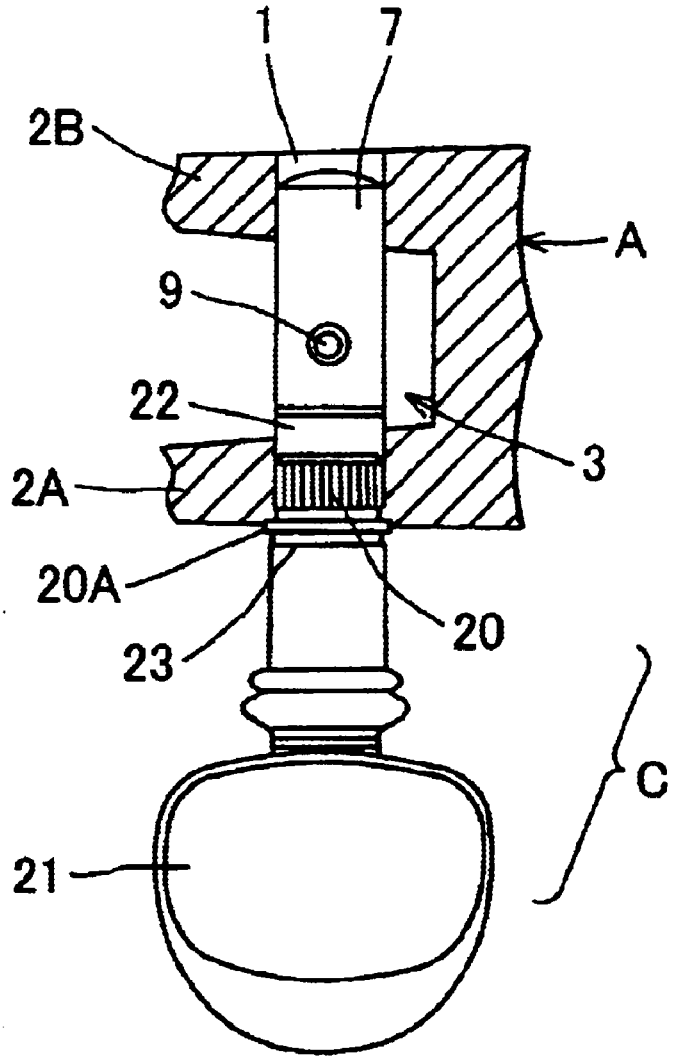
FIG. 5 is a partly sectioned exploded view showing another embodiment of a peg for stringed instruments according to the present invention.
Figure 6:
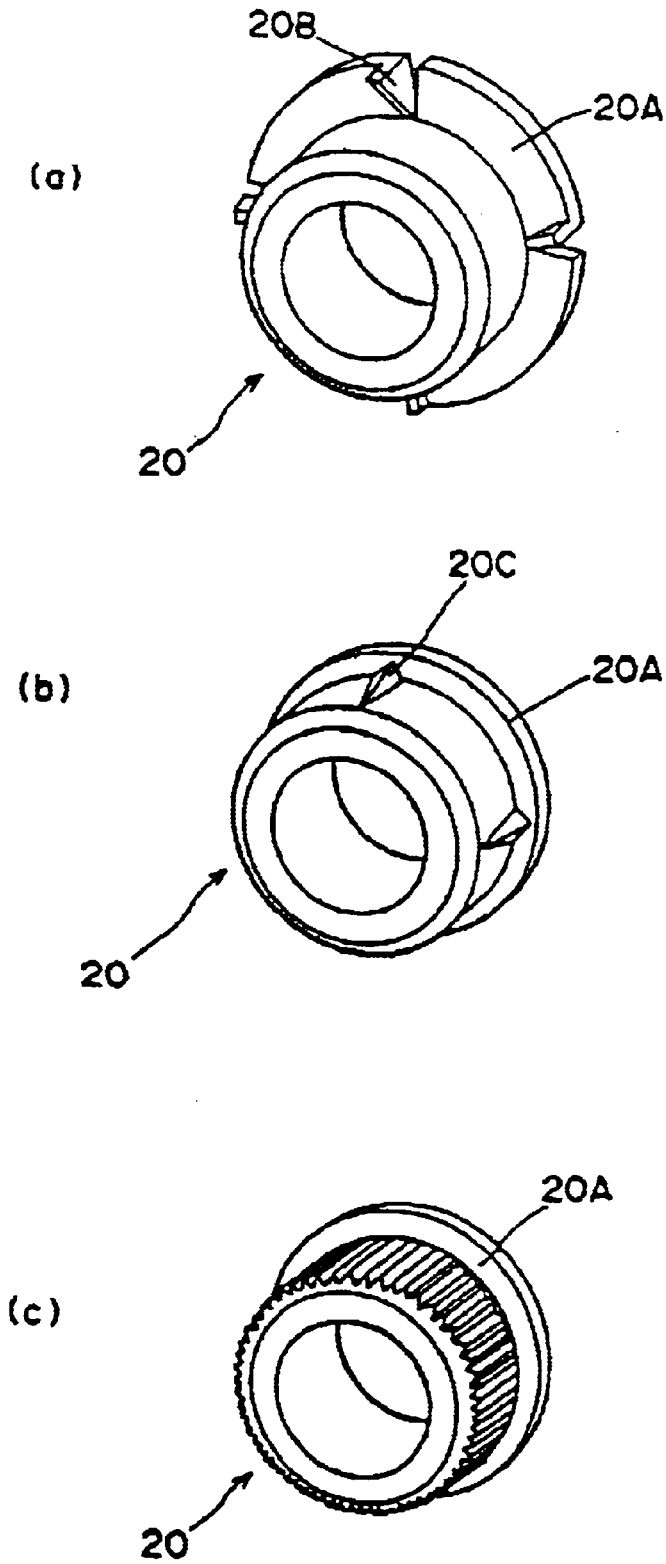
FIG. 6 exemplifies bushings in FIG. 4.
Figure 7:
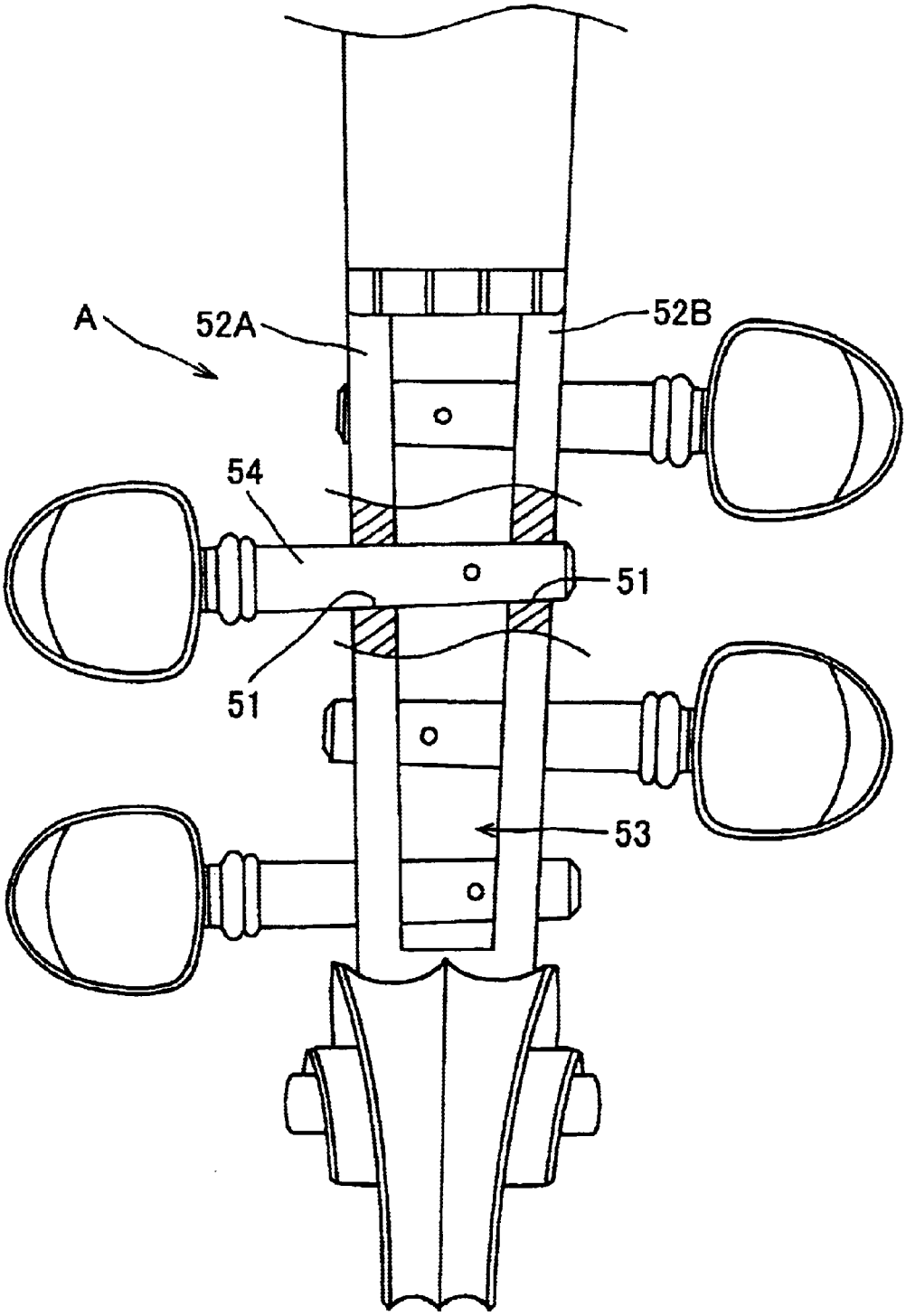
FIG. 7 is a partly sectioned plan view showing an example of a conventional peg mechanism for stringed instruments.
Figure 8:
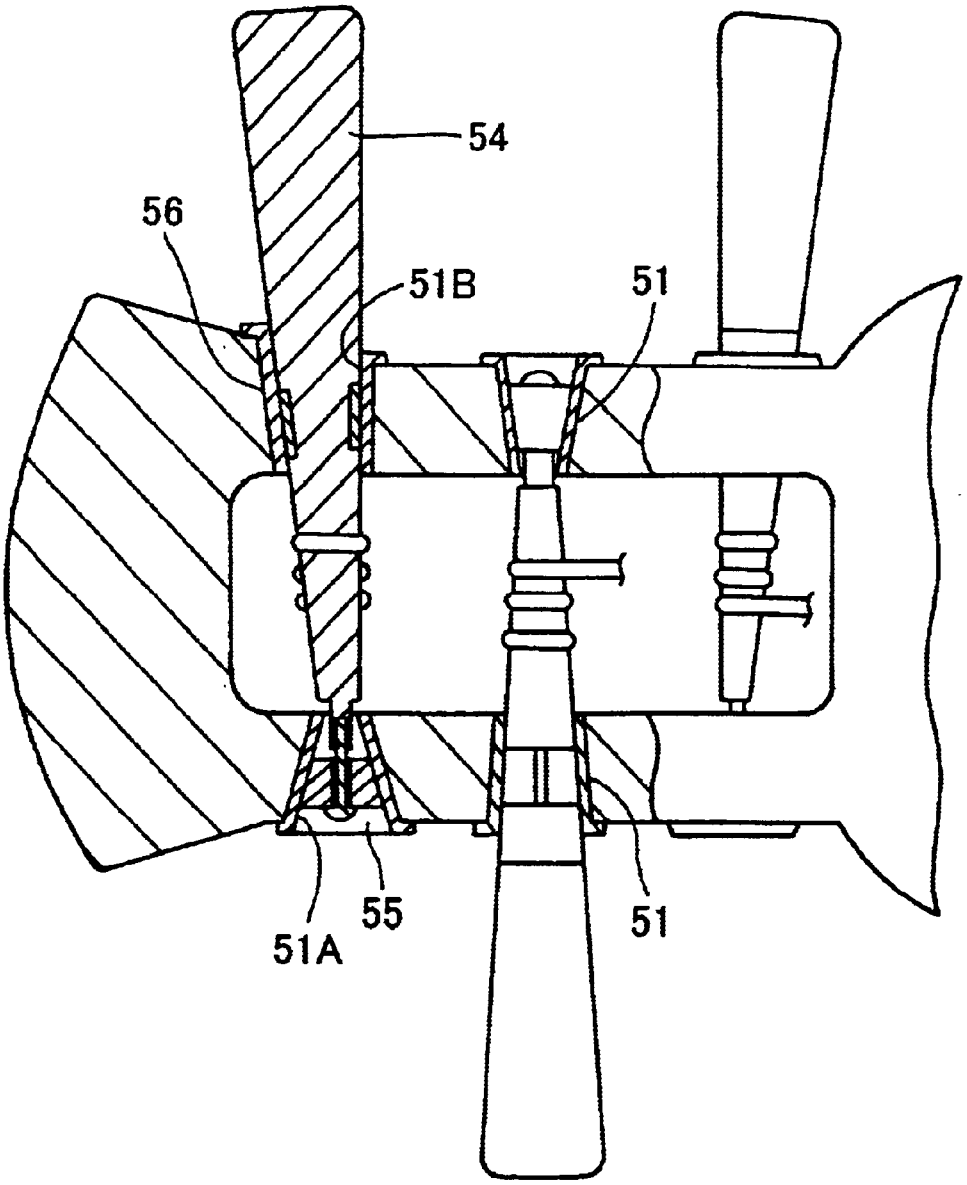
FIG. 8 is a partly sectioned plan view showing another example of a conventional peg for stringed instruments.

As shown in FIGS. 4 and 5, the bushing 20 is fixedly attached in each throughhole 1 in the support wall 2A or 2B, to which the knob 21 is attached from external. The bushing 20 has a through-hole with a size that can receive the shaft driver 8 of the string post 4 therein.

The bushing 20 has an outer circumferential surface with splines formed thereon as shown in FIG. 6C. The outer circumferential surface has such an outer diameter that the bushing 20 can be inhibited to rotate once it is pressed in the throughhole 1 bored in the support wall 2A or 2B.

The bushing 20 has a flange 20A at the base end, which has a diameter larger than that of the throughhole 1. The flange 20A has protrusions 20B serving as anti-rotation pieces as shown in FIG. 6A. These protrusions 20B are originally formed as four notched portions at the time of formation of the bushing 20, forming the outer circumference surface of the bushing 20 columnar, on four locations at an equal interval in parts of the periphery of the flange 20A and bent sharp-pointed inward. Alternatively, as shown in FIG. 6B, forming the outer circumference surface of the bushing 20 having the flange 20A cylindrical, protrusions 20C sharp-pointed may be formed on four locations at an equal interval in parts of the periphery of the bushing 20. These protrusions 20B or 20C are pressed in the throughhole 1 bored in the support wall 2A or 2B to inhibit the rotation of the bushing 20 about the support wall 2A or 2B. It is preferable to inject an adhesive between the bushing 20 and the throughhole 1 to secure the bushing 20 firmly in the throughhole 1.

The bushing 20 of FIG. 6C may also be provided freely with one or both of the protrusions 20B or 20C of FIG. 6A or 6B. The bushing 20 of FIG. 6A or 6B may also be provided freely with the protrusions 20B or 20C. The protrusions 20B or 20C on the bushing 20 of FIG. 6A or 6B, which may be in arbitrary shapes, are required at least three. The knob 21 is attached to the bushing 20 through a washer 23. The male screw 6 is configured to insert through the top of the knob 21. A washer 24 is interposed between the knob 21 and the screw head 6A of the male screw 6.

Operations of the peg mechanism and peg for stringed instruments according to this embodiment will be described next. First, the string post 4 and the knob 21 sandwich the bushing 20 secured in the support wall 2A or 2B to secure them onto the bushing 20 at such the extent that the string post 4 can not rotate due to tension of a string. In this case, when the male screw 6 is rotated in the normal direction to the knob 21, it moves forward relative to the shaft driver 8 of the string post 4. The tip of the shaft driver 8 is configured polygonal The polygonal tip of the shaft driver 8 is inserted into the fit bore 5B of the knob 21, which is configured axially movable but inhibited to rotate relative to tip of the shaft driver 8. Therefore, the knob 21 and the shaft driver 8 can not rotate relative to each other and the shaft driver 8 can be inserted into the fit bore 5B of the knob 21. Along with the insertion of the shaft driver 8, the string winder 7 also moves toward the knob 21 to sandwich the bushing 20 between the string post 4 and the knob 21. The string post 4 and the knob 21 are secured onto the bushing 20 at such the extent that the string post 4 can not rotate due to tension of a string by adjusting the rotational force of the male screw 6.

In the present embodiment, the string post 4 and the knob 21 are configured to sandwich the bushing 20. This sandwiching force can be adjusted when the string post 4 is relatively moved toward the knob 21 by the male screw 6. Accordingly, the string post 4 can be secured by the user at such the extent that it can not rotate due to tension of a string. During the tuning operation for strings, when the sandwiching force by the string post 4 and the knob 21 given to the bushing 20 decreases, the normal rotation of the male screw 6 can increase the sandwiching force to promote the tuning operation.

Also described in the present embodiment is the stringed instrument that includes a pair of support walls in the head stock, though the invention is not limited to this example. Rather it is obvious that the invention is applicable to a stringed instrument that includes a single support wall in a head stock.

According to the peg mechanisms of the first and second aspects of the present invention, the throughhole for receiving the string post therein may comprise a cylindrical hole that has an inner surface with an axially uniform diameter. In addition, the string post may comprise a columnar shaft that has an outer circumferential sur face with an axially uniform diameter. Therefore, it is not required to consider the adjustment of the contact surface of the string post to the throughhole. As a result, the throughhole and the string post can be easily produced The head stock can be easily produced and maintained even by beginners without dedicated tools and simply applied to the existing instruments.

In addition, according to these peg mechanisms, the string post and the knob are configured to sandwich the bushing or the support wall and the adjustment means is configured to relatively displace the string post close to and apart from the knob. Therefore, when the adjustment means displaces the string post and the knob close to each other, the sandwiching force by the string post and the knob given to the bushing or the support wall can be increased To the contrary, when the adjustment means displaces the string post and the knob apart from each other, the sandwiching force by the string post and the knob given to the bushing or the support wall can be decreased As described, the adjustment means can adjust the sandwiching force by the string post and the knob given to the bushing or the support wall. Thus, the string post and the knob can be secured to the bushing or the support wall to such the extent that the string post does not rotate due to tension of a string. Therefore, the user can rotate the string post with the hand easily, reliably and smoothly.

As the string post is not contact directly with the throughhole in the support wall. This can cause no abrasion due to rotation and achieve excellent durability. In addition, the string post and the knob can be easily secured onto the bushing or the support wall with a desired pressure, for example, to such the extent that the string post does not rotate due to tension of a string. Accordingly, fine-tuning can be performed easily at the time of tuning of the string.

According to the second aspect of the present invention, a planar member with three or more protrusions formed on a surface contacting with the support wall is interposed between the string winder of the string post and the support wall and another between the knob and the support wall. As a result, frictions occur at locations that are not contact with wooden parts of the instrument and the planar members can suffer the thrust loads. In addition, the planar members can be maintained approximately in parallel with each other and not rotated when the string post is rotated. Therefore, rotations of the planar members impart no damages on stringed instruments and the sandwiching pressure given from the knob and the string post to the support wall is not lost. At the same time, the string post can rotate smoothly to promote the fine-tuning and the use of tools for fine-tuning such as adjusters can be open omitted. If the planar members are composed of a hard synthetic resin or metal, the instruments can be employed for a long tune period in stable because the degree of abrasion can be decreased for a long time use on locations that cause frictions. Furthermore, any of the string post, the knob and the planar members can be replaced without special tools and techniques at the user side. This can extend a maintenance period and reduce an expense.

A planar member, having the protrusions as anti-rotation pieces, is interposed between the string post and the support wall and another between the knob and the support wall as described above. As a result, the planar member itself is inhibited to rotate. In addition, the string post or the knob may not be parallel to the support wall sometimes, for example, in the case of tapered support walls or a pair of rough parallel support walls. In such the cases, some of the protrusions can be integrated with the support wall or the throughhole by engaging them into the support wall or pressing into the throughhole to make the planar members be substantially parallel. Accordingly, the string post and the knob can sandwich the support wall firmly and uniformly with a desired pressure.

According to the pegs of the third and fourth aspects of the present invention, the throughhole for receiving the string post therein may comprise a cylindrical hole that has an inner surface with an axially uniform diameter. In addition, the string post may comprise a columnar shaft that has an outer circumferential surface with an axially uniform diameter. Therefore, it is not required to consider the adjustment of the contact surface of the string post to the throughhole. As a result, the throughhole and the string post can be easily produced. The head stock can be easily produced and maintained even by beginners without dedicated tools. In addition, the user of the stringed instrument can replace components easily and speedy by his/herself to reduce a time period and expense necessary for maintenance.

What is claimed is:

1. A peg mechanism for stringed instruments, comprising:

a certain number of cylindrical throughholes, each having an inner surface with an axially uniform diameter, provided along the extending direction of a string and sequentially on a support wall formed in a head stock of a stringed instrument;

a bushing composed of an abrasion quality material, sandwiched between a string post for winding a string and a knob for rotating said string post, and secured in said throughhole; and, an adjusting means provided in said string post and said knob for relatively moving said string post close to and apart from said knob by external operations; wherein said bushing is secured in said throughhole by a securing means which has anti-rotation pieces consisting of engaging projections such as knurls and protrusions formed on a circumferential surface of a portion adjacent to the inside of said throughhole.

2. The peg mechanism for stringed instruments according to claim 1, wherein said string post is coupled to said knob for rotating said string post by an anti-rotation means which is movable axially but inhibited to rotate.

3. The peg mechanism for stringed instruments according to claim 1, wherein said anti-rotation means for said string post and said knob comprises fit members for fitting one with the other and engaging with each other during rotations.

4. The peg mechanism for stringed instruments according to claim 1, said adjusting means including:

a female threaded portion provided on the tip of one of said string post and said knob, said string post and said knob arranged on the same center line; and, a male screw provided on the other of said string post and said knob, operative from external, for engaging in and from said female threaded portion to relatively move said string post close to and apart from said knob.

5. A peg mechanism for stringed instruments, comprising:

throughholes provided on a support wall formed in a head stock of a stringed instrument, said throughholes provided sequentially along the extending direction of a string;

a string post, pivotally inserted in each of said throughholes, for winding a string, wherein;

said throughholes are each bored cylindrically to have an inner surface with an axially uniform diameter;

said support wall at said throughhole part is sandwiched between said string post and a knob for rotating said string post;

an adjusting means is provided in said string post and said knob for relatively moving said string post close to and apart from said knob by external operations; and, planar members composed of an abrasion quality material such as a washer and a bushing are interposed between a string winder of said string post and said support wall and between said knob and said support wall, said planar members each having three or more projections contacting said support wall, formed at an appropriate interval.

6. The peg mechanism for stringed instruments according to claim 5, wherein said string post is coupled to said knob for rotating said string post by an anti-rotation means which is movable axially but inhibited to rotate.

7. The peg mechanism for stringed instruments according to claim 5, wherein said anti-rotation means for said string post and said knob comprises fit members for fitting one with the other and engaging with each other during rotations.

8. The peg mechanism for stringed instruments according to claim 5, wherein at least one of said planar members comprises a bushing secured in said throughhole, said bushing having engaging projections such as knurls and protrusions formed on a circumferential surface of a portion adjacent to the inside of said throughhole.

9. The peg mechanism for stringed instruments according to claim 5, said adjusting means including:

a female threaded portion provided on the tip of one of said string post and said knob, said string post and said knob arranged on the same center line; and, a male screw provided on the other of said string post and said knob, operative from external, for engaging in and from said female threaded portion to relatively move said string post close to and apart from said knob.

10. A peg for stringed instruments, comprising:

a string post consisting of a string winder and a shaft driver provided adjacent to said string winder;

a knob coupled to said string post for rotating said string post; and, a bushing composed of an abrasion quality material, sandwiched between said string post and said knob, and secured in a throughhole bored in a support wall of a head stock;

wherein an anti-rotation means axially movable but inhibited to rotate, and an adjusting means for relatively moving said string post close to and apart from said knob by external operations are provided in said string post and said knob; wherein said bushing is secured in said throughhole by a securing means which has anti-rotation pieces consisting of engaging projections such as knurls and protrusions formed on a circumferential surface of a portion adjacent to the inside of said throughhole.

11. The peg for stringed instruments according to claim 10, wherein said anti-rotation means for said string post and said knob comprises fit members for fitting one with the other and engaging with each other during rotations.

12. The peg for stringed instruments according to claim 10, said adjusting means including:

a female threaded portion provided on the tip of one of said string post and said knob, said string post and said knob arranged on the same center line; and, a male screw provided on the other of said string post and said knob, operative from external, for engaging in and from said female threaded portion to relatively move said string post close to and apart from said knob.

13. A peg for stringed instruments, comprising:

a string post consisting of a string winder and a shaft driver provided adjacent to said string winder, said shaft driver inserted into a throughhole bored in a support wall of a head stock in a stringed instrument;

a knob coupled to said string post and having an anti-rotation means movable along the axis of said string winder of said string post but inhibited to rotate; and, planar members secured in said throughholes, at a portion between said knob and said support wall, and at a portion between a string winder of said string post and said support wall, said planar members each having anti-rotation pieces into which said shaft driver is inserted;

wherein an adjusting means is provided between said string post and said knob for relatively moving said string post close to and apart from said knob by external operations; and, said planar members comprise planar members such as a washer and a bushing composed of an abrasion quality material and having three or more projections contacting said support wall, formed at an appropriate interval.

14. The peg for stringed instruments according to claim 13, wherein said anti-rotation means for said string post and said knob comprises fit members for fitting one with the other and engaging with each other during rotations.

15. The peg for stringed instruments according to claim 13, said adjusting means including:

a female threaded portion provided on the tip of one of said string post and said knob, said string post and said knob arranged on the same center line; and, a male screw provided on the other of said string post and said knob, operative from external, for engaging in and from said female threaded portion to relatively move said string post close to and apart from said knob.

16. The peg for stringed instruments according to claim 13, wherein at least one of said planar members comprises a bushing secured in said throughhole, said bushing having engaging projections such as knurls and protrusions formed on a circumferential surface of a portion adjacent to the inside of said throughhole.

* * * * *

UNITED STATES PATENT AND TRADEMARK OFFICE

CERTIFICATE OF CORRECTION

PATENT NO. : 6,706,956 B1
DATED : March 16, 2004
INVENTOR(S) : Masaki Gotoh

It is certified that error appears in the above-identified patent and that said Letters Patent is hereby corrected as shown below:

Title page,
Item [56], References Cited, U.S. PATENT DOCUMENTS, please insert the following:

-- 5,018,424 05/91 Steinberger
1,721,904 07/29 Grover --

FOREIGN PATENT DOCUMENTS, insert the following:

-- GB 145545 09/21 --

Column 3,
Line 44, "external or" should be -- external for --
Line 53, "al" should be -- at --

Column 6,
Line 19, "SB" should be -- 5B --
Line 37, "IS" should be -- 15 --

Column 10,
Line 14, "open" should be -- often --
Line 16, "tune" should be -- time --

Signed and Sealed this

Thirteenth Day of July, 2004

JON W. DUDAS
*Acting Director of the United States Patent and Trademark Office*